US006429631B2

(12) United States Patent
Inaba et al.

(10) Patent No.: US 6,429,631 B2
(45) Date of Patent: Aug. 6, 2002

(54) REGULATED POWER SOURCE CIRCUIT INCLUDING AN OVERCURRENT DETECTING MECHANISM FOR ELIMINATING LOSS IN THE OUTPUT CONTROL ELEMENT

(75) Inventors: Katsumi Inaba, Tondabayashi; Tomohiro Suzuki, Kashihara; Kohji Hisakawa; Tsutomu Satou, both of Kitakatsuragi-gun, all of (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 09/794,363

(22) Filed: Feb. 28, 2001

(30) Foreign Application Priority Data

Feb. 29, 2000 (JP) ..... 2000-054601

(51) Int. Cl.[7] ..... G05F 1/573
(52) U.S. Cl. ..... 323/277; 323/901
(58) Field of Search ..... 323/276, 277, 323/278, 901

(56) References Cited

U.S. PATENT DOCUMENTS 4,809,122 A * 2/1989 Fitzner ..... 323/278
4,831,483 A * 5/1989 Matsumura et al. ..... 323/278
5,666,044 A * 9/1997 Tuozzolo ..... 323/277
5,942,881 A * 8/1999 Oxada et al. ..... 323/901

FOREIGN PATENT DOCUMENTS

JP 6038520 10/1994 ..... H02M/3/28

* cited by examiner

*Primary Examiner*—Jeffrey Sterrett

(57) ABSTRACT

In the regulated power supply circuit, an overcurrent detection circuit detects the flow of an overcurrent through a transistor acting as an output control element and supplies a result of the detection to a cut-off operation prohibition circuit. During non-startup time of the regulated power supply circuit, the cut-off operation prohibition circuit simply relays a result of the overcurrent detection circuit detecting an overcurrent to a cut-off circuit without introducing any changes to the result. The cut-off circuit increases a base potential of the transistor according to the result of the detection of an overcurrent to cut off the output of the transistor. It is ensured that the output voltage rises even if the overcurrent detection circuit has activated the cut-off circuit upon detection of the overcurrent temporarily passing through the transistor during a startup. Therefore, the cut-off operation prohibition circuit prohibits the cut-off circuit from performing the cut-off operation from the outset to the end of the startup. Hence, a regulated power supply circuit can be provided which, even if an overcurrent is detected, develops no loss in the transistor during non-startup time.

48 Claims, 12 Drawing Sheets

REGULATED POWER SOURCE CIRCUIT INCLUDING AN OVERCURRENT DETECTING MECHANISM FOR ELIMINATING LOSS IN THE OUTPUT CONTROL ELEMENT

FIELD OF THE INVENTION

The present invention relates to regulated power supply circuits and regulated power supply devices, and in particular, overcurrent protection mechanisms.

BACKGROUND OF THE INVENTION

We will first discuss conventional regulated power supply circuits in reference to FIG. 11 which is a circuit block diagram representing a dropper-type regulated power supply circuit 51. In the regulated power supply circuit 51, a PNP power transistor TR1 hereinafter, transistor TR1 acting as an output control element drops an input voltage Vin to produce an output voltage Vo. During normal operation, an error amplifier 53 compares a partial voltage of the output voltage Vo detected by resistors R1 and R2 to a reference voltage supplied from a constant voltage circuit 54. The error amplifier 53 adjusts the base current of a transistor TR5 according to an error obtained from the comparison, which in turn adjusts the base current of a transistor TR1 via a transistor TR2 to keep the output voltage Vo at a constant value.

However, an overcurrent flowing through the collector of the transistor TR1 reduces the output voltage Vo. In contrast, under a normal condition, an overcurrent detection circuit 52, upon detection of such an overcurrent, directly varies the base potential of the transistor TR1 for the purpose of restraining the current flow.

When a load R3 is short-circuited, the output voltage V0 of the transistor TR1 falls to GND level, and so does the potential at the contact between the resistors R1 and R2. Therefore, in the short circuit protection circuit 56, the base potential of the transistor TR3 falls. This turns on the transistor TR3 and thus produces a current flow to the resistor R4, which then elevates the base potential of, and thus turns on, the transistor TR4. As a result, the current flow from the constant current circuit 55 to the base of the transistor TR5 branches off to be coupled to the collector of the transistor TR4. This reduces the base current of the transistor TR5 and causes the current flow to the base of the transistor TR2 to branch off to the emitter, then the base, of the transistor TR3, and further pass through the diode D1 and the resistor R2. Accompanying great fall in the base current of the transistor TR2 causes a great fall in the base current of the transistor TR1, limiting the output current Io of the transistor TR1.

When the output short circuit is incomplete as described above, however, a problem develops such that great loss occurs at the transistor TR1. To explain this phenomenon, reference is made to FIG. 12 showing overcurrent limiting characteristics representing a relationship between the output voltage Vo and output current Io of a typical regulated power supply circuit.

A complete short circuit, denoted by point A in FIG. 12, is a condition in which a resistor with a small impedance is used to short-circuit the output terminals to completely short-circuit the output. At point A, a loss of (Vin−Vo)×Io occurs in the transistor TR1; however, the output current Io is limited to a small value, and the loss is relatively small.

In contrast, an incomplete short circuit, denoted by point B in FIG. 12, is a condition in which a resistor with a greater impedance than in the case of a complete short circuit is used to short-circuit the output terminals. At point B, the output current Io is not limited, and the loss of (Vin−Vo)×Io grows large. If the device is in such a condition for an extended period, various inconveniences will entail including breakdown of the device and heating of the printed wire board.

Although the foregoing description clearly predicts the importance of curbing the loss in the output control element when the short circuit is incomplete and an overcurrent is detected, attempt to be compatible with every kind of overcurrent results in restraining the indispensable overcurrent that occurs inevitably during a startup in which the output voltage Vo rises to an operating level. This renders it to difficult to start up the device.

SUMMARY OF THE INVENTION

The present invention has an objective to provide regulated power supply circuits and regulated power supply devices such that no loss develops in the output control element when overcurrent flows, except during a startup.

A regulated power supply circuit in accordance with the present invention, in order to achieve the above objective, includes:

- an output control element;
- an overcurrent detection circuit for detecting an overcurrent flowing through the output control element;
- a cut-off circuit for cutting off an output of the output control element when the overcurrent detection circuit detects the overcurrent; and
- a cut-off operation prohibition circuit for prohibiting the cut-off circuit from performing the cut-off operation from an outset to an end of a startup of the regulated power supply circuit.

According to the invention, when the overcurrent detection circuit detects an overcurrent flowing through the output control element, the cut-off circuit operates to cut off the output of the output control element. This way, if an overcurrent is caused by a short circuit, whether complete or incomplete, no current is allowed to run through the output control element, thus developing no loss in the output control element. However, the output voltage will not build up provided that the output of the output control element is cut off in response to an overcurrent that occurs inevitably during a startup. Therefore, the cut-off operation prohibition circuit is adapted to prohibit the cut-off circuit from performing the cut-off operation from the outset to the end of the startup.

Hence, a regulated power supply circuit can be provided which, even if an overcurrent is detected, develops no loss in the output control element during non-startup time.

A regulated power supply device in accordance with the present invention, fabricated by sealing an integrated regulated power supply circuit in a single package, in order to achieve the above objective, is such that the regulated power supply circuit includes:

- an output control element;
- an overcurrent detection circuit for detecting an overcurrent flowing through the output control element;
- a cut-off circuit for cutting off an output of the output control element when the overcurrent detection circuit detects the overcurrent; and
- a cut-off operation prohibition circuit for prohibiting the cut-off circuit from performing the cut-off operation from an outset to an end of a startup of the regulated power supply circuit.

According to the invention, the regulated power supply circuit is integrated and sealed in a single package and is therefore can be readily mounted on a printed board.

For a fuller understanding of the nature and advantages of the invention, reference should be made to the ensuing detailed description taken in conjunction with the accompanying drawings.

DESCRIPTION OF THE EMBODIMENTS

Referring to FIG. 1 to FIG. 10, the following description will discuss embodiments of the regulated power supply circuit and the regulated power supply device in accordance with the present invention.

Figure 1:
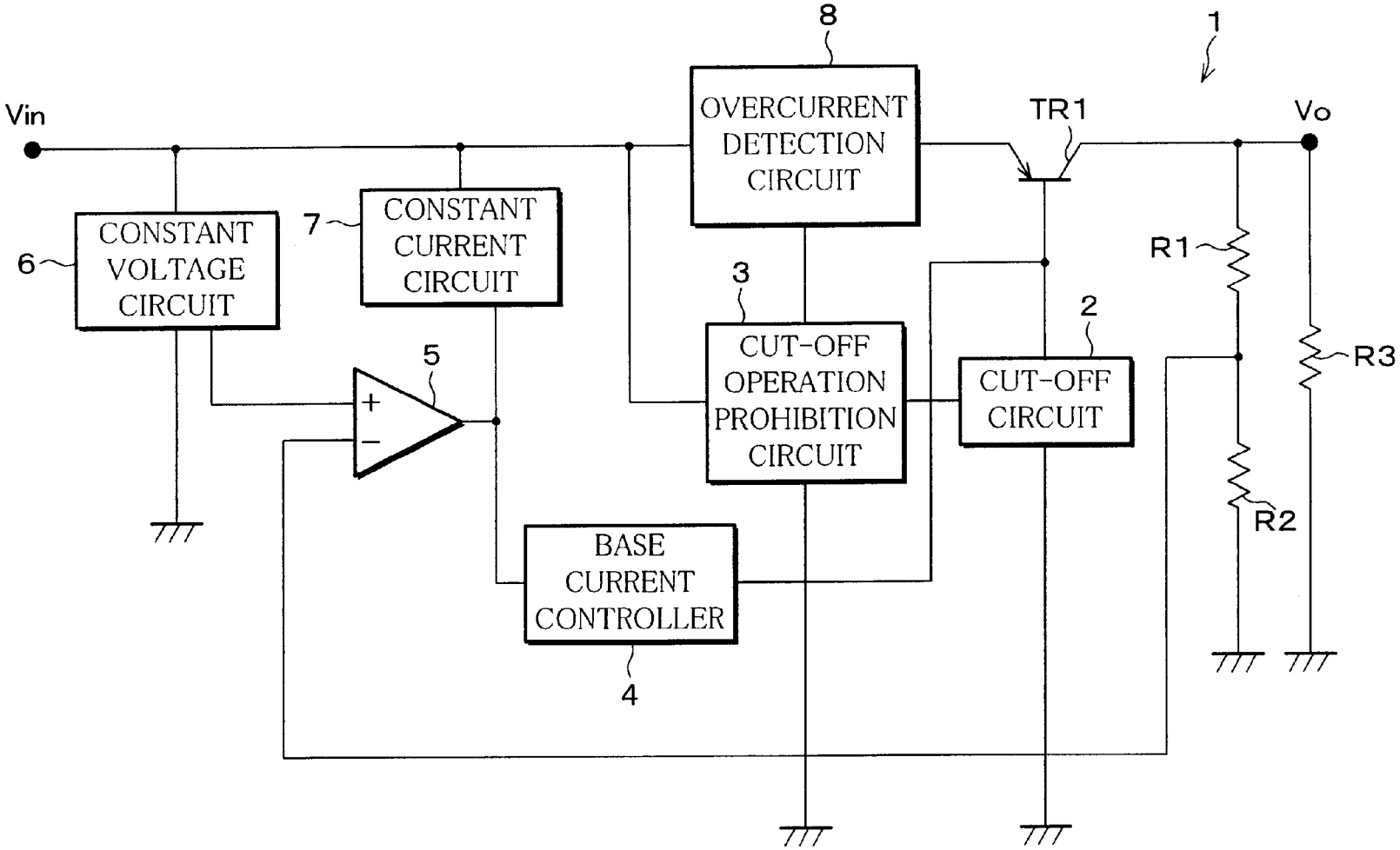
FIG. 1 is a block circuit diagram showing an arrangement of a regulated power supply circuit in accordance with an embodiment of the present invention.

FIG. 1 illustrates the concept behind the arrangement of a regulated power supply circuit 1 of the present embodiment. The regulated power supply circuit 1, being coupled to a load R3 at its output terminal, includes a transistor TR1, a cut-off circuit 2, a cut-off operation prohibition circuit 3, a base current controller 4, an error amplifier 5, a constant voltage circuit 6, a constant current circuit 7, an overcurrent detection circuit 8, and resistors R1 and R2.

The transistor TR1, acting as an output control element, is a PNP power transistor which cause the input voltage Vin coupled to its emitter to drop so as to produce an output voltage Vo. The resistors R1 and R2 are voltage dividing resistors disposed between an output line and a GND line, forming an output voltage detection circuit for detecting an output voltage Vo. The error amplifier 5 is for comparing a result of the resistors R1 and R2 detecting a divided voltage of an output voltage Vo to a reference voltage produced by the constant voltage circuit 6. The constant voltage circuit 6, powered through the input line, is for producing a constant voltage and feeding it to the error amplifier 5.

The base current controller 4 either increases or decreases the base current of the transistor TR1 according to a result of the comparison by the error amplifier 5, by varying the current fed from the constant current circuit 7, so as to keep the output voltage Vo at a constant value. The constant current circuit 7, powered through the input line, is for producing a constant current and feeding it to the based current controller 4. The overcurrent detection circuit 8 is for detecting overcurrents passing through the transistor TR1 and providing a result of the detection to the cut-off operation prohibition circuit 3. During non- startup time, the cut-off operation prohibition circuit 3 simply relays a result of the overcurrent detection circuit 8 detecting an overcurrent to the cut-off circuit 2 without introducing any changes to the result. The cut-off circuit 2 increases the base potential of the transistor TR1 according to the result of the detection of an overcurrent to cut off the output of the transistor TR1. During a startup, an overcurrent may temporarily pass through the transistor TR1, but the output voltage Vo will not build up provided that the overcurrent detection circuit 8 detects the overcurrent and activates the cut-off circuit 2. Therefore, the cut-off operation prohibition circuit 3 is adapted to prohibit the cut-off circuit 2 from performing the cut-off operation from the outset to the end of the startup.

This way, during non-startup time, when an overcurrent is caused by a short circuit, whether complete or incomplete, no current is allowed to run through the transistor TR1, thus developing no loss in the transistor TR1. Hence, a regulated power supply circuit can be provided which, even if an overcurrent is detected, develops no loss in the output control element during non-startup time.

Now, we will take several specific examples to further explain the cut-off operation prohibition circuit 3 and associated arrangement.

EXAMPLE 1

Figure 2:
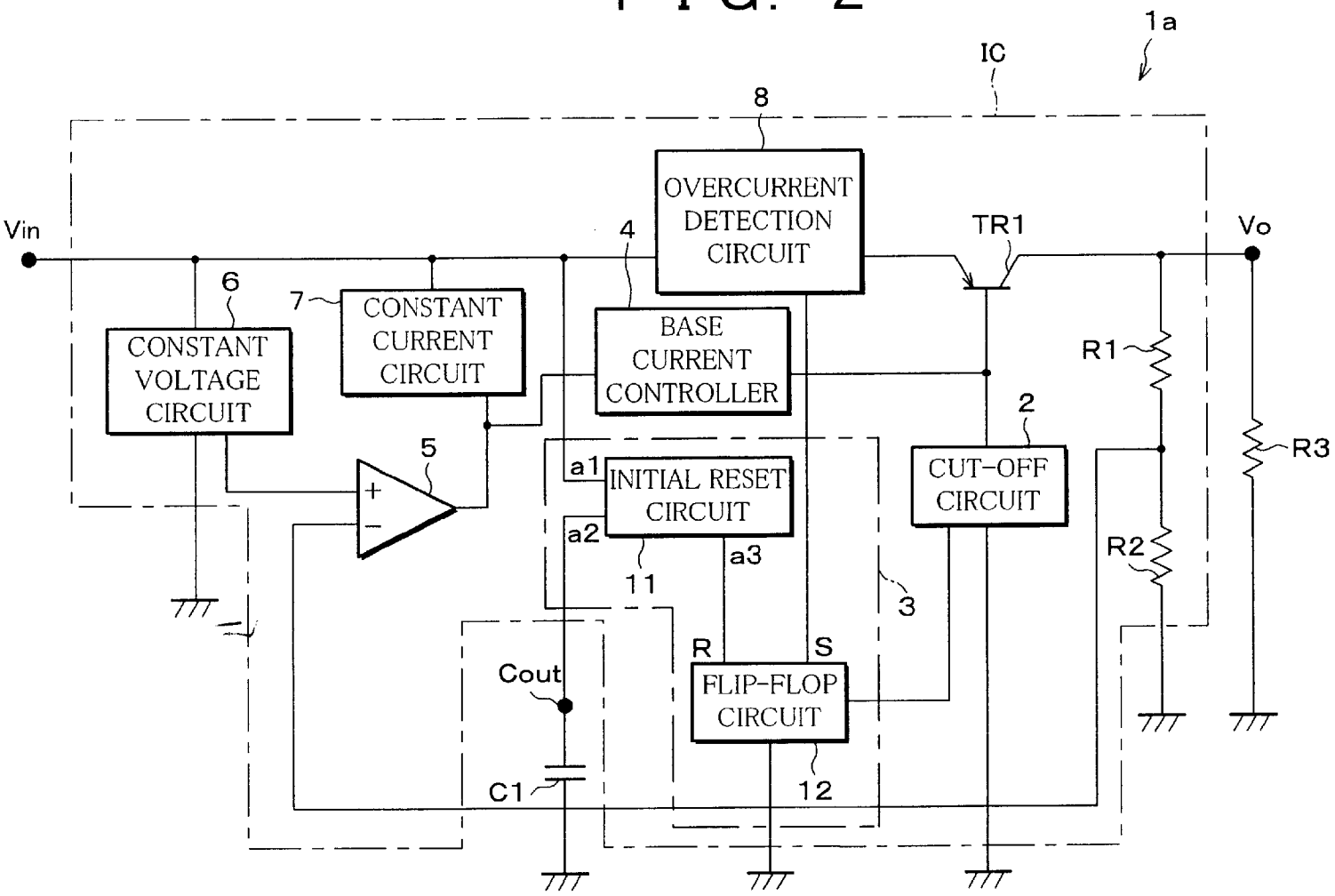
FIG. 2 is a block circuit diagram showing an arrangement of example 1 of the regulated power supply circuit of FIG. 1.

FIG. 2 shows a circuit arrangement in a regulated power supply circuit 1*a* which is example 1 of the regulated power supply circuit 1.

The cut-off operation prohibition circuit 3 is made of an initial reset circuit 11 and an RS flip-flop circuit 12. The initial reset circuit 11 has two input terminals: the input terminal a1 is connected to the input line, while the input terminal a2 is connected to a Cout terminal. A capacitor C1 is interposed between the Cout terminal and the GND line. The initial reset circuit 11 starts charging the capacitor C1 at the outset of a startup, and continues to supply a reset signal ("1") from the output terminal a3 to the reset terminal R of the RS flip-flop circuit 12 until a potential difference builds up across the capacitor C1 to a level that can be regarded as an end of the startup, that is, until the output voltage Vo of the transistor TR1 rises to an operating level.

Thereby, the RS flip-flop circuit 12 rejects the input of a set signal ("1") from the overcurrent detection circuit 8 detecting an overcurrent and provides a signal prohibiting the cut-off operation to the cut-off circuit 2. When the potential difference across the capacitor C1 increases to a level that can be regarded as an end of the startup, the initial reset circuit 11 stops the output of the reset signal (outputs a "0" signal) to the RS flip-flop circuit 12 based on the potential difference across the capacitor Cl. Thereby, after this, if the overcurrent detection circuit 8 detects an overcurrent and supplies a set signal ("1") to the set terminal S of the RS flip-flop circuit 12, the RS flip-flop circuit 12 supplies a signal which causes the cut-off circuit 2 to perform a cut-off operation. In this manner, the regulated power supply circuit 1*a* of the present example is adapted so that it does not cut off the output of the output control element in response to an overcurrent that occurs inevitably during a startup.

Now, we will focus the discussion on the initial reset circuit 11 and the RS flip-flop circuit 12.

Figure 3:
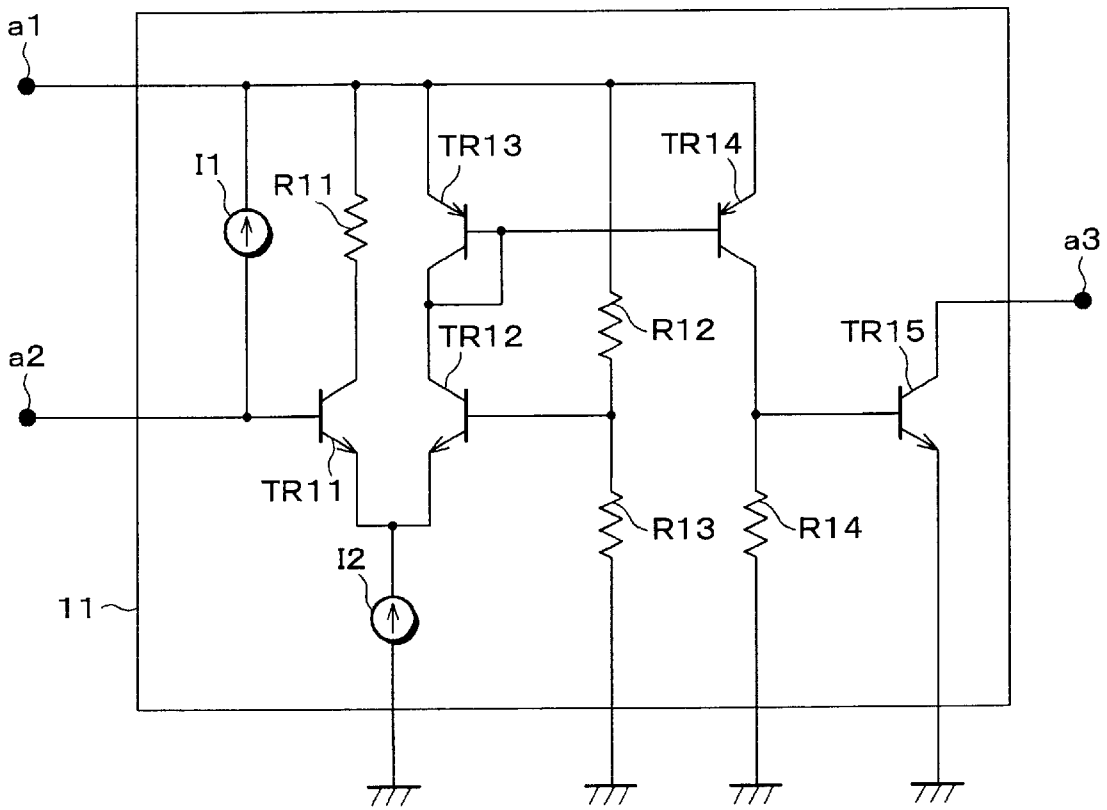
FIG. 3 is a circuit diagram showing an arrangement of a part of the regulated power supply circuit of FIG. 2.

FIG. 3 shows an arrangement of the initial reset circuit 11. In FIG. 3, a constant current source I1 is disposed linking the input terminal a1 to the input terminal a2, and the base of a NPN transistor TR11 is connected to the input terminal a2. The collector of the transistor TR11 is connected to the input terminal a1 via a resistor R11, while its emitter is connected to a GND line via a constant current source I2. The emitter of the NPN transistor TR12 is connected to the emitter of the transistor TR11, while the base of the transistor TR12 is connected to the contact between the resistors R12 and R13 that are disposed in series between the input terminal a1 and the GND line. The collector of the transistor TR12 is connected to the collector of the PNP transistor TR13.

The base of the transistor TR13 is connected to its own collector and also to the base of the PNP transistor TR14. The emitters of the transistors TR13 and TR14 both connected to the input terminal a1 so that the transistors TR13 and TR14 form a current mirror. The collector of the transistor TR14 is connected to a GND line via the resistor R14. The contact between the collector of the transistor TR14 and the resistor R14 is connected to the base of the NPN transistor TR15. The collector of the transistor TR15 is connected to the output terminal a3, while its emitter is connected to a GND line.

In the initial reset circuit 11 arranged as above, when an input voltage Vin is introduced, a charge current flows to the capacitor C1 from the constant current source I1. When the potential difference increases to a level that can be regarded as an end of the startup, the transistor TR11 turns on and causes a current to flow to the resistor R11 via the constant current source I2, setting the emitter of the transistor TR11 to low level. Accordingly, the voltage, across the base and emitter of the transistor TR12, which exceeds a threshold value, turns on the transistor TR12 and causes a current to flow through the current mirror. Here, as a result of the base potential of the transistor TR15 switching to high level, the transistor TR15 turns on, and the output terminal a3 switches to low level. In other words, the startup is completed, and the supply of the reset signal is stopped.

Figure 4:
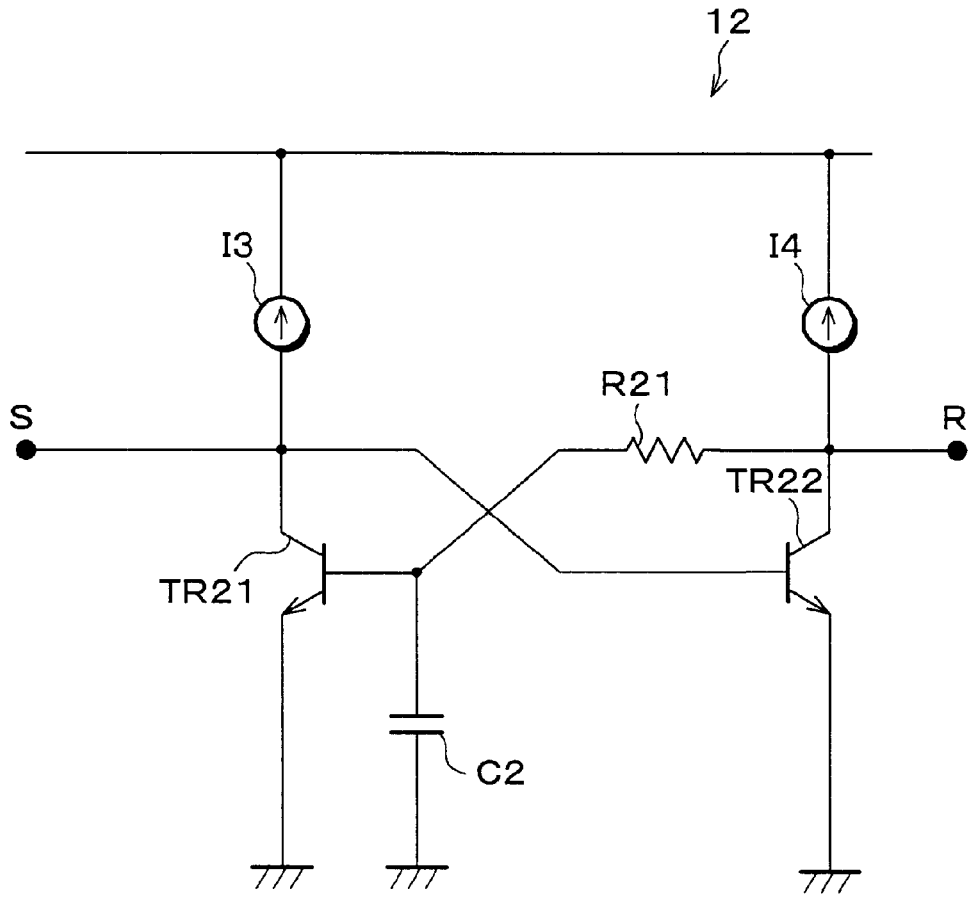
FIG. 4 is a circuit diagram showing an arrangement of another part of the regulated power supply circuit of FIG. 2.

Reference is now made to FIG. 4 showing an arrangement of an RS flip-flop 12. In FIG. 4, NPN transistors TR21 and TR22 are disposed linking an input line to a GND line so that their collectors are connected to the input line via a constant current source I3 and a constant current source I4 respectively and their emitters are connected to a GND line. A capacitor C2 is disposed linking the base of the transistor TR21 to the GND line. A resistor R21 is disposed linking the base of the transistor TR21 to the collector of the transistor TR22. The base of the transistor TR22 is connected to the collector of the transistor TR21. The collector of the transistor TR21 is a set terminal S, and the collector of the transistor TR22 is a reset terminal R.

As a result of the aforementioned operation of the initial reset circuit 11, while a high level signal is being coupled to the reset terminal R, the potential difference across the capacitor C2 keeps the transistor TR21 turned on, and the set terminal S stays at low level. As the supply of the reset signal is stopped, since the capacitor C2 discharges through the resistor R21, the set terminal S becomes ready to receive a high level signal.

EXAMPLE 2

Figure 5:
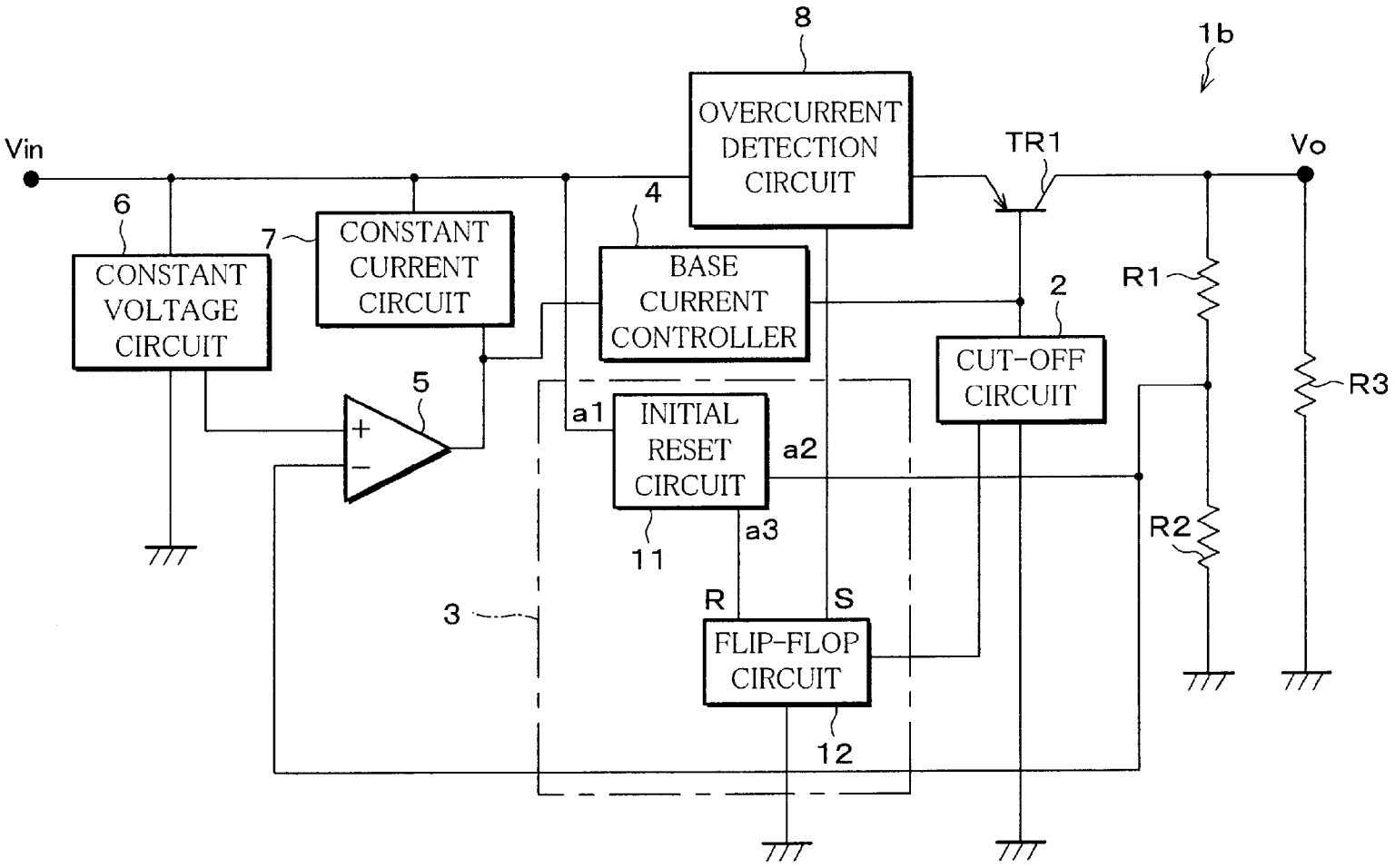
FIG. 5 is a block circuit diagram showing an arrangement of example 2 of the regulated power supply circuit of FIG. 1.

FIG. 5 shows an arrangement of a regulated power supply circuit 1*b* which is example 2 of the regulated power supply circuit 1.

Similarly to the regulated power supply circuit 1*a* of example 1, the regulated power supply circuit 1*b* employs an initial reset circuit 11 and an RS flip-flop circuit 12 as the cut-off operation prohibition circuit 3. However, a result of resistors R1 and R2 detecting an output voltage Vo is coupled to the input terminal a2 of the initial reset circuit 11. The arrangement causes the initial reset circuit 11 to determine that the circuit is in a startup as long as the output voltage Vo stays below a predetermined value and to continue to supply a reset signal to the RS flip-flop circuit 12 to prohibit the cut-off circuit 2 from performing a cut-off operation until the output voltage Vo reaches a predetermined value that can be regarded as an end of the startup.

In this manner, the regulated power supply circuit 1*b* of the present embodiment is adapted so that it does not cut off the output of the output control element in response to an overcurrent that occurs inevitably during a startup.

EXAMPLE 3

Figure 6:
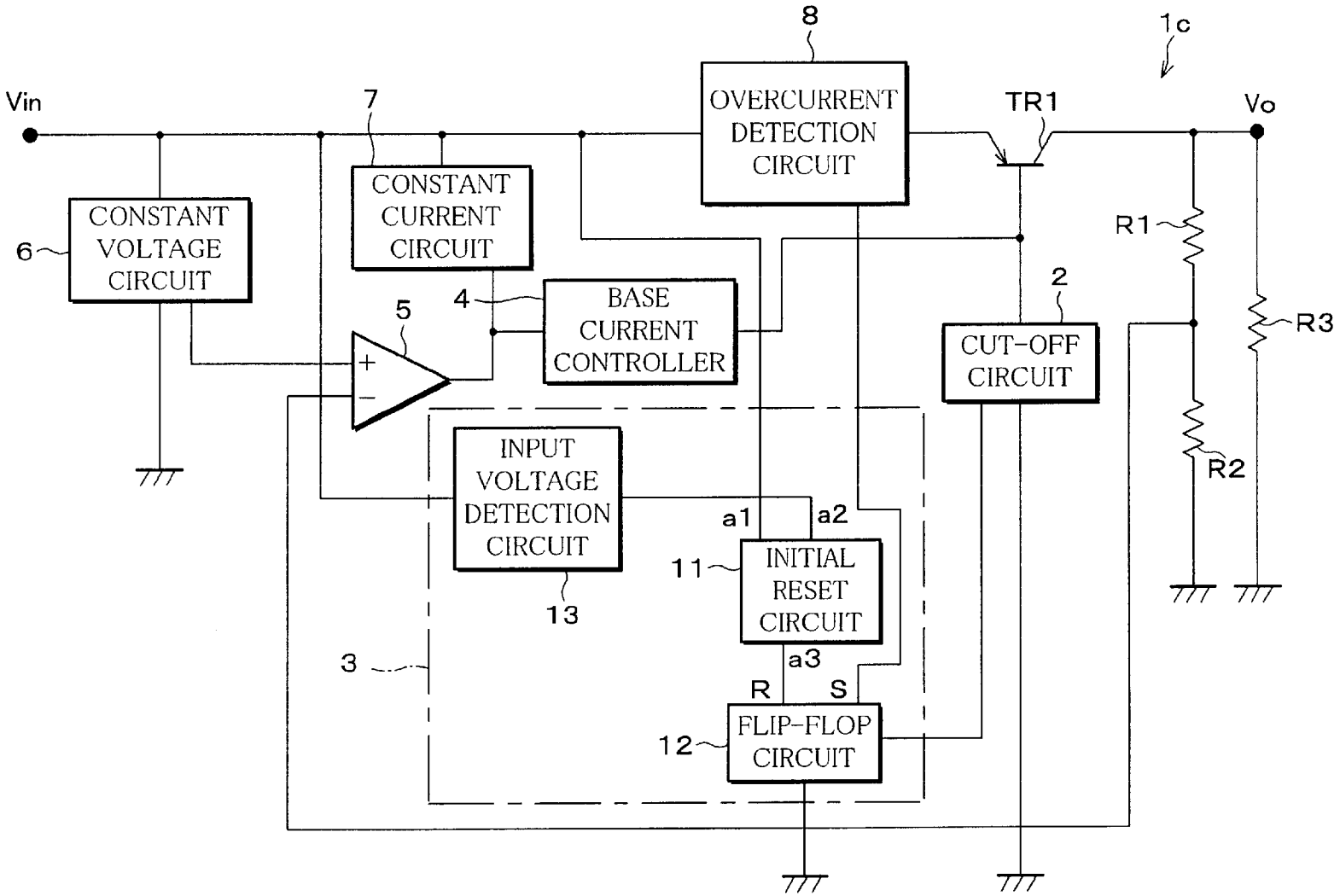
FIG. 6 is a block circuit diagram showing an arrangement of example 3 of the regulated power supply circuit of FIG. 1.

FIG. 6 shows an arrangement of a regulated power supply circuit 1*c* which is example 3 of the regulated power supply circuit 1.

Similarly to the regulated power supply circuit 1*a* of example 1, the regulated power supply circuit 1*c* employs an initial reset circuit 11 and an RS flip-flop circuit 12 as the cut-off operation prohibition circuit 3. Additionally, there is provided an input voltage detection circuit 13 for detecting the input voltage Vin. A result of the input voltage detection circuit 13 detecting the input voltage Vin is coupled to the input terminal a2 of the initial reset circuit 11. The arrangement causes the initial reset circuit 11 to determine that the circuit is in a startup as long as the input voltage Vin stays below a predetermined value and to continue to supply a reset signal during the startup until the input voltage Vin reaches a value that can be regarded as an end of the startup, that is, until the input voltage Vin rises. The RS flip-flop circuit 12, in response to the incoming reset signal, prohibits the cut-off circuit 2 from performing a cut-off operation. In this manner, the regulated power supply circuit 1*c* of the present embodiment is adapted so that it does not cut off the output of the output control element in response to an overcurrent that occurs inevitably during a startup.

EXAMPLE 4

Figure 7:
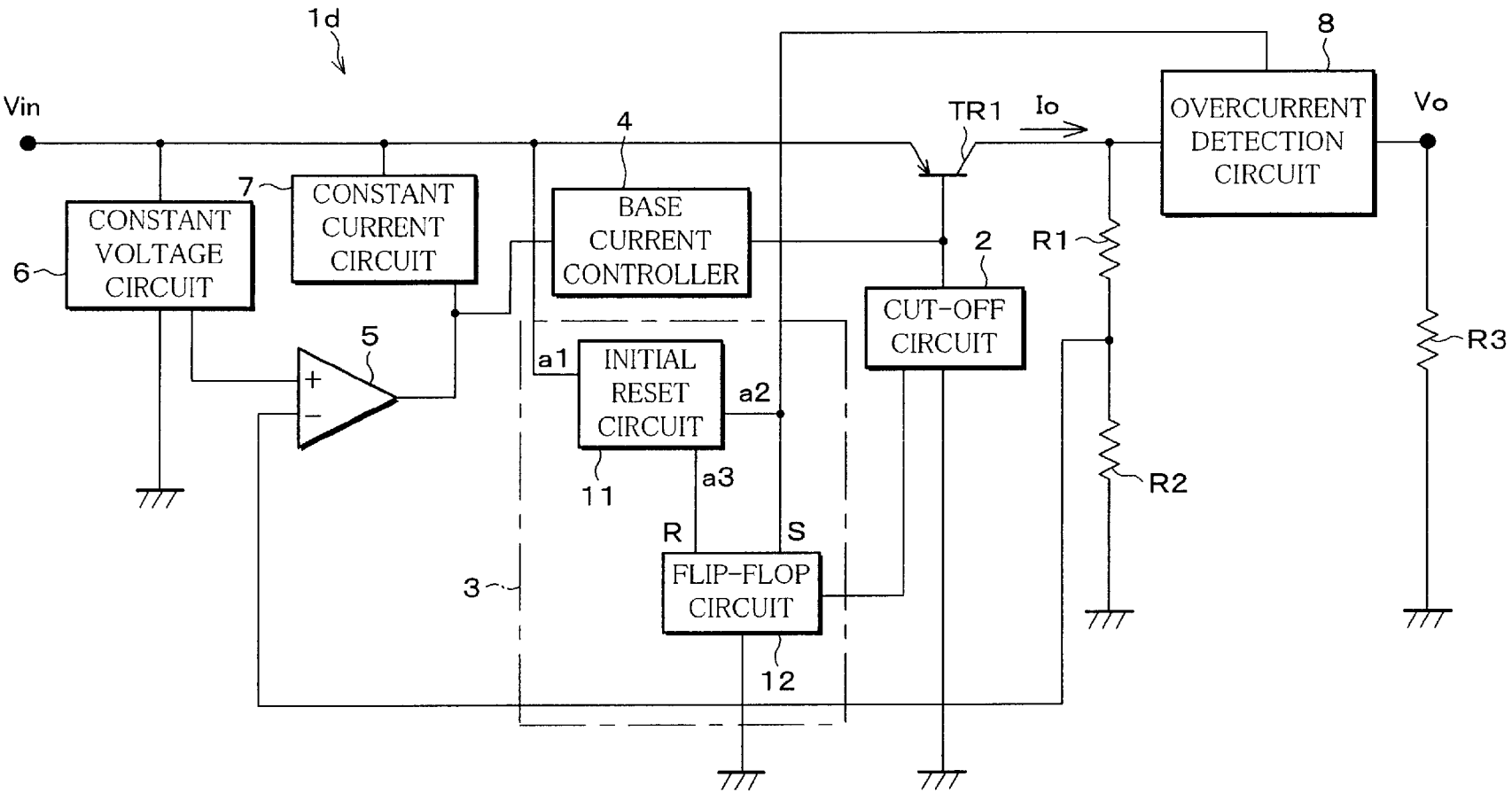
FIG. 7 is a block circuit diagram showing an arrangement of example 4 of the regulated power supply circuit of FIG. 1.

FIG. 7 shows an arrangement of a regulated power supply circuit id which is example 4 of the regulated power supply circuit 1.

Similarly to the regulated power supply circuit 1*a* of example 1, the regulated power supply circuit 1*d* employs an initial reset circuit 11 and an RS flip-flop circuit 12 as the cut-off operation prohibition circuit 3. Additionally, there is provided an overcurrent detection circuit 8, for detecting the output current Io, as an output current detection circuit along an output line in the regulated power supply circuit 1*d*. A result of the overcurrent detection circuit 8 detecting the output current Io is coupled to the input terminal a2 of the initial reset circuit 11.

The initial reset circuit 11 continues to supply a reset signal during the startup until the output current Io reaches a value that can be regarded as an end of the startup, that is, until the output current Io rises. The RS flip-flop circuit 12 thereby prohibits the cut-off circuit 2 from performing a cut-off operation. To distinguish between a complete rise of the output current Io and a temporary overcurrent that occurs inevitably during a startup, the output current Io is converted to voltage and integrated, for example. In such a case, the cut-off operation is prohibited until the value of the definite integral becomes equal to a predetermined value.

In this manner, the regulated power supply circuit 1*d* of the present embodiment is adapted so that it does not cut off the output of the output control element in response to an overcurrent that occurs inevitably during a startup.

EXAMPLE 5

Figure 8:
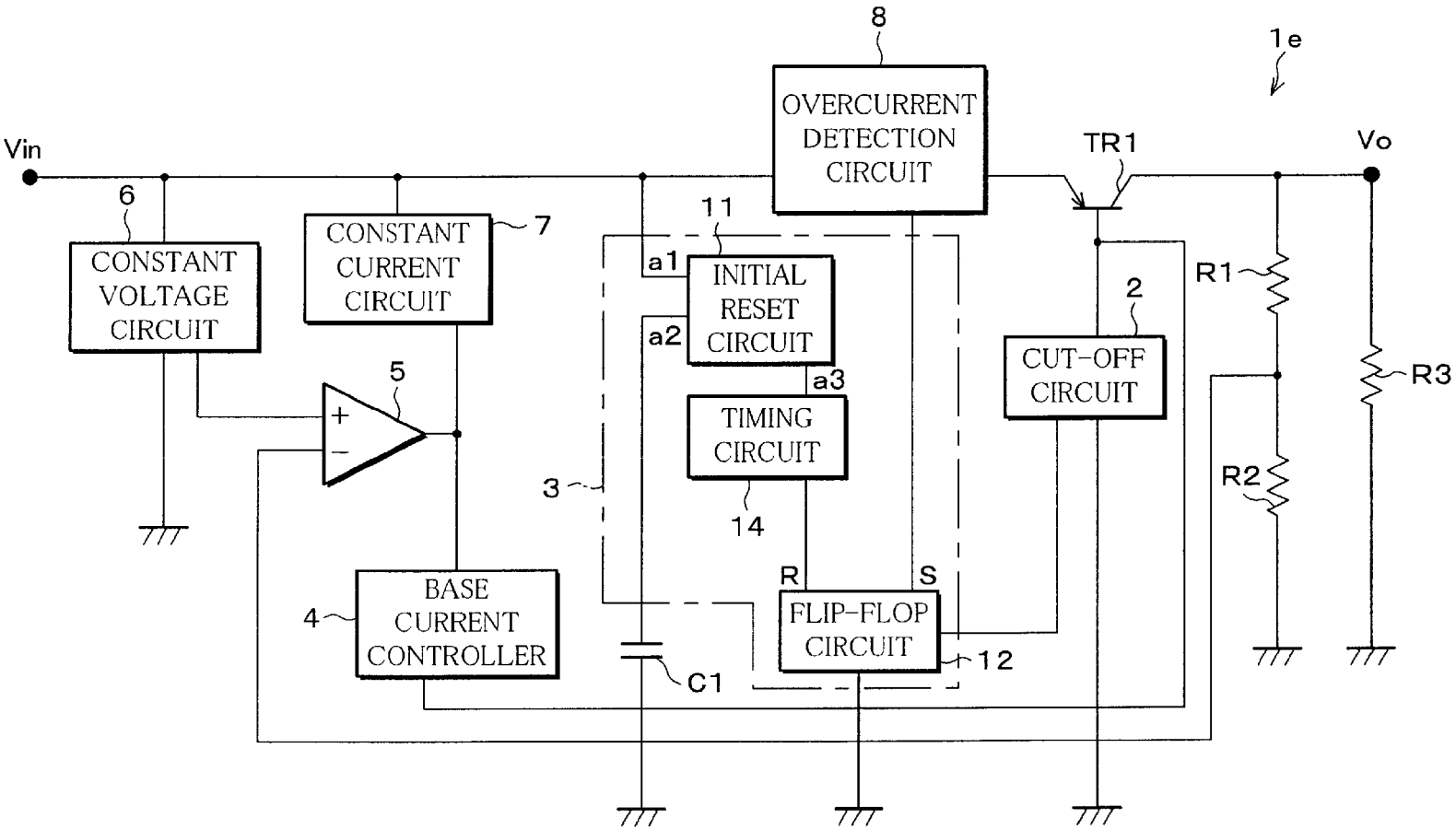
FIG. 8 is a block circuit diagram showing an arrangement of example 5 of the regulated power supply circuit of FIG. 1.

FIG. 8 shows an arrangement of a regulated power supply circuit 1*e* which is example 5 of the regulated power supply circuit 1.

The regulated power supply circuit 1*d* employs the initial reset circuit 11 and RS flip-flop circuit 12 of example 1, as well as an additionally provided timing circuit 14, as the cut-off operation prohibition circuit 3. When the capacitor C1 is charged to such a voltage level that the transistor TR11 of FIG. 3 turns on, the timing circuit 14 delays the time to stop the initial reset circuit 11 from supplying a reset signal to the RS flip-flop circuit 12 by a predetermined amount. Put differently, the timing circuit 14 prohibits the cut-off circuit 2 from performing a cut-off operation until a predetermined amount of time elapses after the end of the startup of the regulated power supply circuit 1*e*. In this manner, the regulated power supply circuit 1*e* of the present embodiment is adapted so that the cut-off circuit 2 can perform a cut-off operation only after the circuit has completely started up.

In examples 2 to 4, the timing circuit 14 may be interposed, as shown in FIG. 8, between the initial reset circuit 11 and the RS flip-flop circuit 12.

In the regulated power supply circuit 1*b* of example 2, the timing circuit 14 may be disposed to delay the time to stop the initial reset circuit 11 from supplying a reset signal to the RS flip-flop circuit 12 by a predetermined amount when the output voltage Vo detected by the resistors R1 and R2 reaches a predetermined value that can be regarded as an end of the startup. In the regulated power supply circuit 1*c* of example 3, the timing circuit 14 may be disposed to delay the time to stop the initial reset circuit 11 from supplying a reset signal to the RS flip-flop circuit 12 by a predetermined amount when the input voltage Vin detected by the input voltage detection circuit 13 reaches a predetermined value that can be regarded as an end of the startup. In the regulated power supply circuit 1*d* of example 4, the timing circuit 14 may be disposed to delay the time to stop the initial reset circuit 11 from supplying a reset signal to the RS flip-flop circuit 12 by a predetermined amount when the output current Io detected by the overcurrent detection circuit 8 reaches a predetermined value that can be regarded as an end of the startup.

EXAMPLE 6

Figure 9:
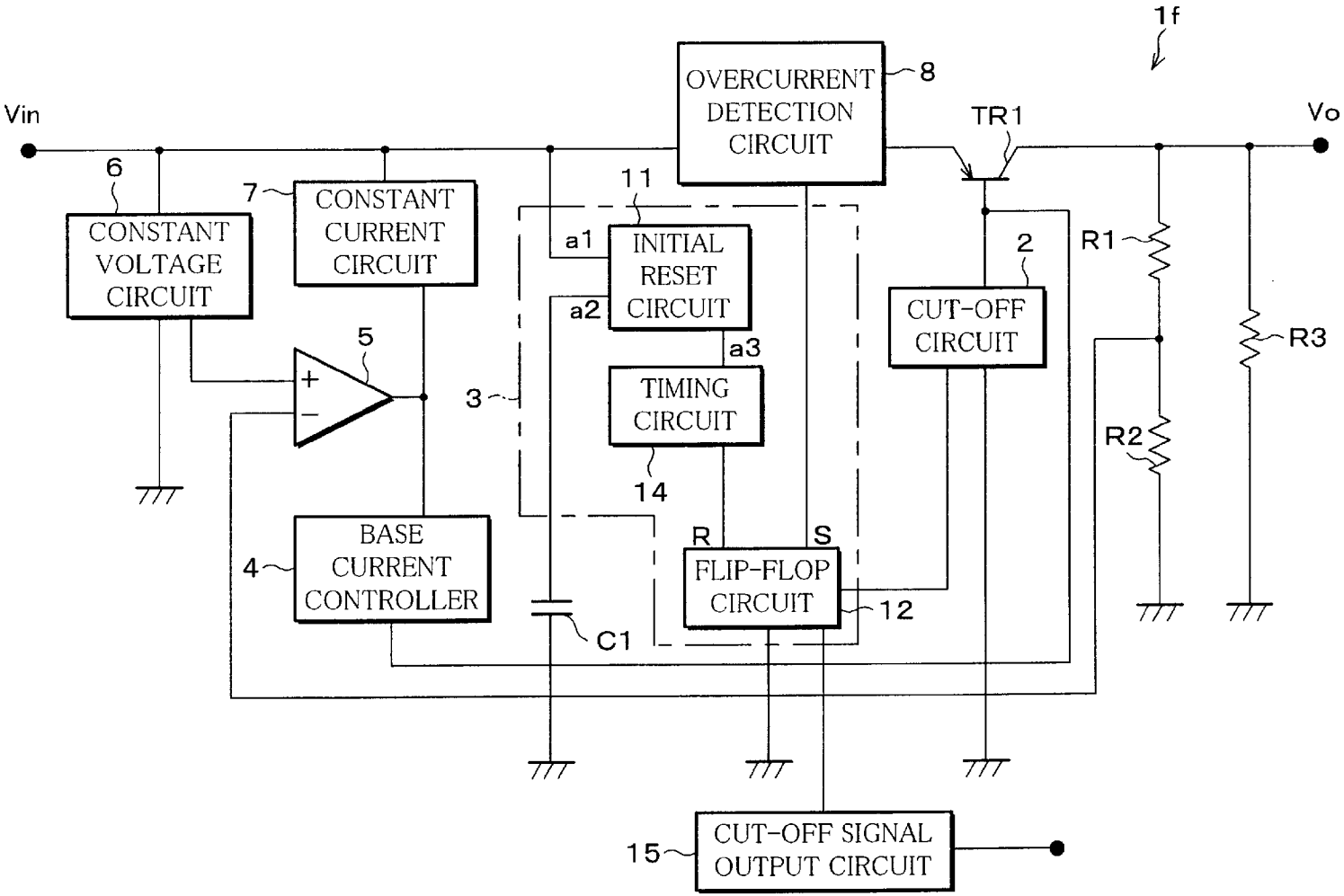
FIG. 9 is a block circuit diagram showing an arrangement of example 6 of the regulated power supply circuit of FIG. 1.

FIG. 9 shows an arrangement of a regulated power supply circuit 1*f* which is example 6 of the regulated power supply circuit 1.

The regulated power supply circuit if of the present example is essentially identical to the regulated power supply circuit 1*e* of example 5, but further includes a cut-off signal output circuit 15. If the overcurrent detection circuit 8 detects an overcurrent at the end of the startup of the regulated power supply circuit 1*f*, the RS flip-flop circuit 12 supplies a signal indicative of the cut-off circuit 2 having been instructed to perform a cut-off operation. In response to that incoming signal, the cut-off signal output circuit 15 supplies a signal indicative of it having cut off the output of the transistor TR1. The signal may be used by the user in any manner; examples of usages include a display or warning indicating that the overcurrent protection has been triggered. In this manner, the regulated power supply circuit if of the present embodiment is adapted so that it can transmit externally the signal indicative of it having cut off the output of the output control element.

Figure 10:
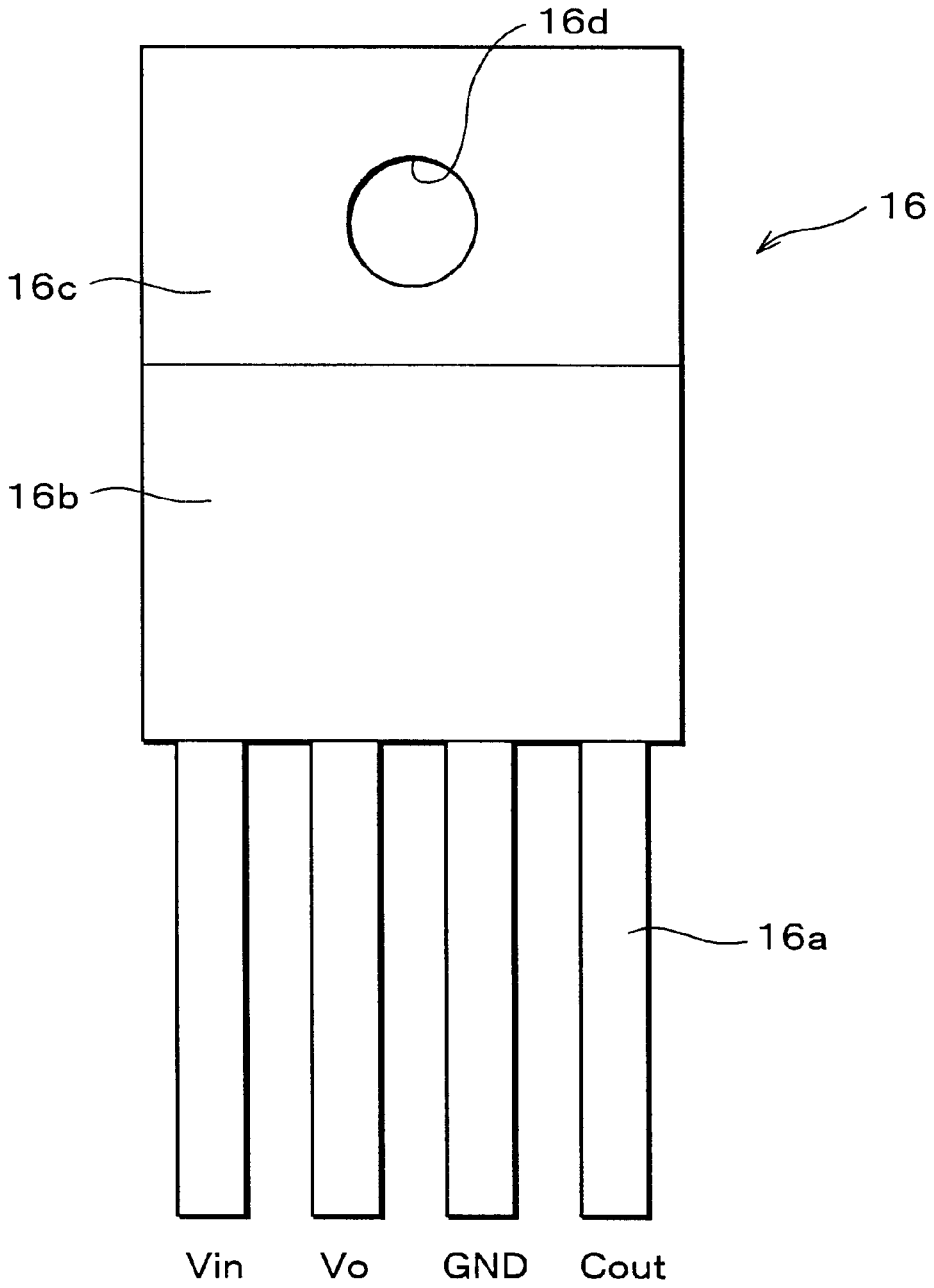
FIG. 10 is a plan view showing an arrangement of a regulated power supply device of the foregoing specific examples.
Figure 11:
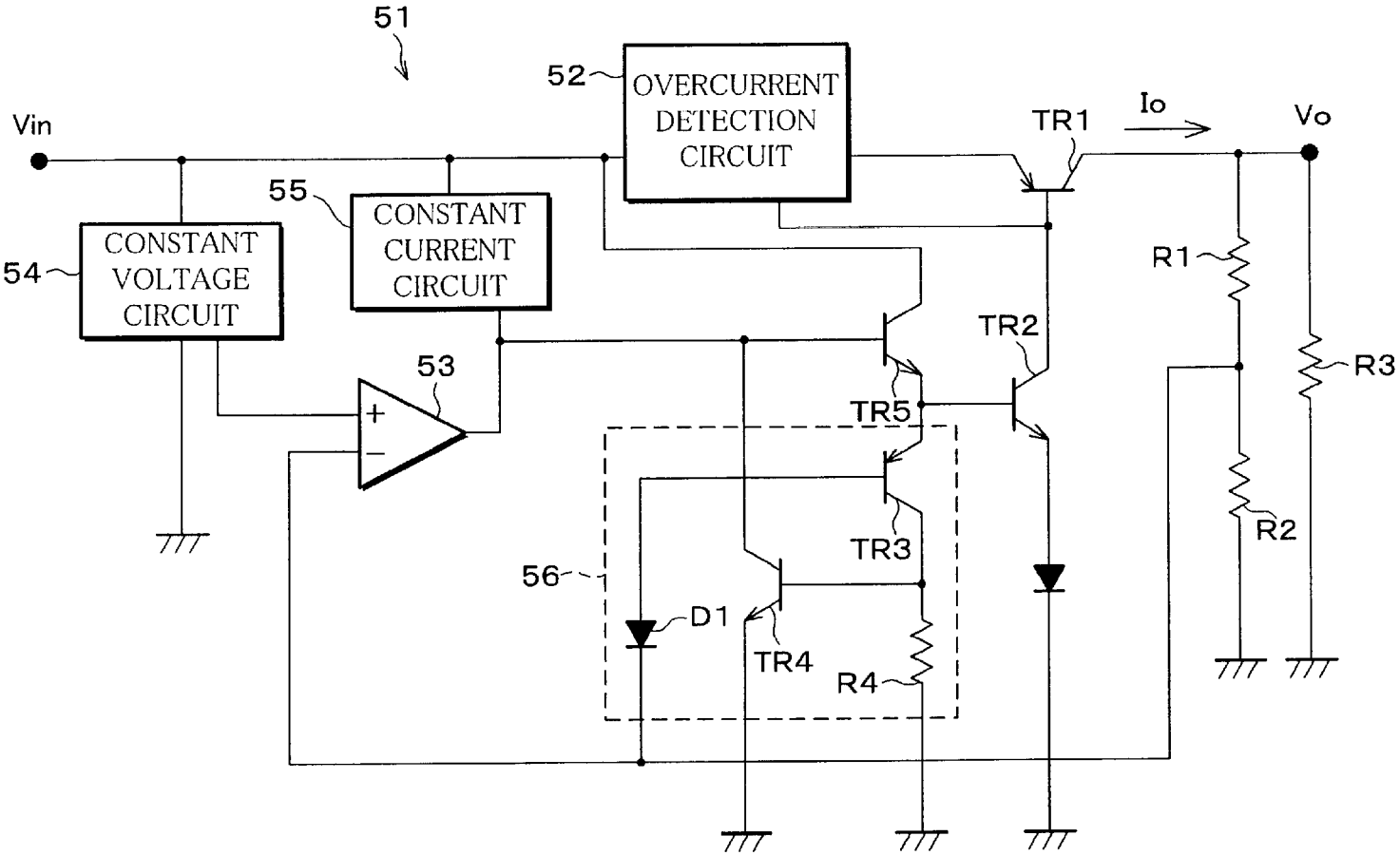
FIG. 11 PRIOR ART
FIG. 11 is a block diagram showing an arrangement of a conventional regulated power supply circuit.
Figure 12:
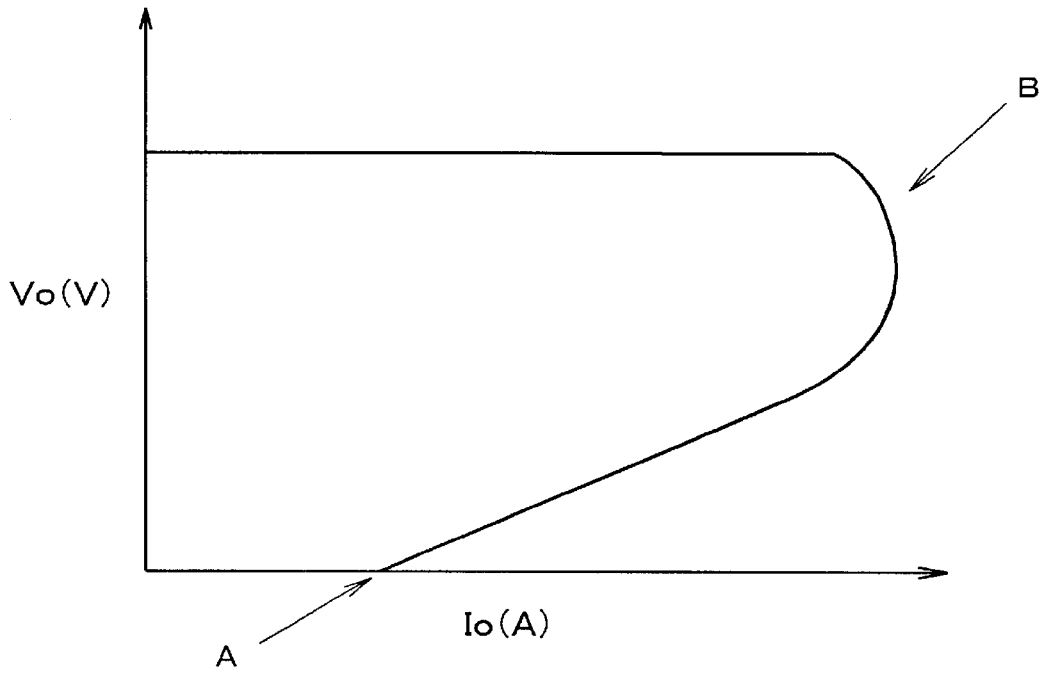
FIG. 12 PRIOR ART
FIG. 12 is a graph showing overcurrent limiting characteristics of a typical regulated power supply circuit.

Each one of the foregoing regulated power supply circuits 1, 1*a*, 1*b*, 1*c*, 1*d*, 1*e*, and if may be integrated and packaged like a regulated power supply device 16 of FIG. 10. The regulated power supply device 16 of FIG. 10 is a packaged, integrated version of the regulated power supply circuit 1*a* of FIG. 2 sealed with a resin 16*b*.

Lead terminals 16*a* are provided which include an input terminal for the input voltage Vin, an output terminal for an output voltage Vo, a GND terminal, and a Cout terminal to which the capacitor C1 is connected. Additional 1*e* ad terminals 16*a* may also be provided which include, in the case of the regulated power supply circuit 1*f* of FIG. 9, an output terminal of the cut-off signal output circuit 15. On a side of the resin 16*b* is provided a radiator plate 16*c* which can be clamped to, for example, a heat sink at a screw hole 16*d*. Using such a regulated power supply device 16, the regulated power supply circuits 1, 1*a*, 1*b*, 1*c*, 1*d*, 1*e*, and 1*f* can be readily mounted on a printed board.

As described in detail so far, the regulated power supply circuit in accordance with the present invention is a regulated power supply circuit with an overcurrent detection circuit for detecting an overcurrent flowing through an output control element and is preferably includes:

a cut-off circuit for cutting off the output of the output control element when the overcurrent detection circuit detects the overcurrent; and a cut-off operation prohibition circuit for prohibiting the cut-off circuit from performing the cut-off operation from the outset to the end of a startup.

According to the invention, when the overcurrent detection circuit detects the overcurrent flowing through the output control element, the cut-off circuit operates to cut off the output of the output control element. This way, if an overcurrent is caused by a short circuit, whether complete or incomplete, no current is allowed to run through the output control element, thus developing no loss in the output control element. However, the output voltage will not build up provided that the output of the output control element is cut off in response to an overcurrent that occurs inevitably during a startup. Therefore, the cut-off operation prohibition circuit is adapted to prohibit the cut-off circuit from performing the cut-off operation from the outset to the end of the startup.

Hence, the regulated power supply circuit can be provided which, even if an overcurrent is detected, develops no loss in the output control element during non-startup time.

The regulated power supply circuit in accordance with the present invention is preferably such that:

it further includes a capacitor starting charging at the outset of the startup; and the cut-off operation prohibition circuit prohibits the cut-off operation during the startup until a potential difference across the capacitor reaches a value that can be regarded as an end of the startup.

According to the invention, a capacitor is provided which starts charging at the outset of the startup, so that the potential difference across the capacitor is coupled to the cut-off operation prohibition circuit. The cut-off operation prohibition circuit prohibits the cut-off circuit from performing a cut-off operation during a startup until the potential difference across the capacitor increases to a value that can be regarded as an end of the startup, that is, until the output voltage of the output control element rises. In this manner, the regulated power supply circuit is adapted so that it does not cut off the output of the output control element in response to an overcurrent that occurs inevitably during a startup.

The regulated power supply circuit in accordance with the present invention is preferably such that:

it further includes an output voltage detection circuit for detecting the output voltage of the output control element and supplying a result of the detection to the cut-off operation prohibition circuit; and the cut-off operation prohibition circuit prohibits the cut-off operation during the startup until the output voltage reaches a value that can be regarded as an end of the startup.

According to the invention, an output voltage detection circuit is provided which detects the output voltage of the output control element, so that the result of the detection is supplied to the cut-off operation prohibition circuit. The cut-off operation prohibition circuit prohibits the cut-off circuit from performing a cut-off operation during a startup until the output voltage reaches a value that can be regarded as an end of the startup, that is, until the output voltage rises. In this manner, the regulated power supply circuit is adapted so that it does not cut off the output of the output control element in response to an overcurrent that occurs inevitably during a startup.

The regulated power supply circuit in accordance with the present invention is preferably such that:

it further includes an input voltage detection circuit for detecting the input voltage of the output control element and supplying a result of the detection to the cut-off operation prohibition circuit; and the cut-off operation prohibition circuit prohibits the cut-off operation during the startup until the input voltage reaches a value that can be regarded as an end of the startup.

According to the invention, an input voltage detection circuit is provided which detects the input voltage of the output control element, so that the result of the detection is supplied to the cut-off operation prohibition circuit. The cut-off operation prohibition circuit prohibits the cut-off circuit from performing a cut-off operation during a startup until the input voltage reaches a value that can be regarded as an end of the startup, that is, until the input voltage rises. In this manner, the regulated power supply circuit is adapted so that it does not cut off the output of the output control element in response to an overcurrent that occurs inevitably during a startup.

The regulated power supply circuit in accordance with the present invention is preferably such that:

it further includes an output current detection circuit for detecting an output current of the output control element and supplying a result of the detection to the cut-off operation prohibition circuit; and the cut-off operation prohibition circuit prohibits the cut-off operation during the startup until the output current reaches a value that can be regarded as an end of the startup.

According to the invention, an output current detection circuit is provided which detects the output current of the output control element, so that the result of the detection is supplied to the cut-off operation prohibition circuit. The cut-off operation prohibition circuit prohibits the cut-off circuit from performing a cut-off operation during a startup until the output current reaches a value that can be regarded as an end of the startup, that is, until the output current rises. To distinguish between the rise of the output current and a temporary overcurrent that occurs inevitably during a startup, the output current is converted to voltage and integrated, for example. In such a case, the cut-off operation is prohibited until the value of the definite integral becomes equal to a predetermined value. In this manner, the regulated power supply circuit is adapted so that it does not cut off the output of the output control element in response to an overcurrent that occurs inevitably during a startup.

The regulated power supply circuit in accordance with the present invention is preferably such that:

the cut-off operation prohibition circuit prohibits the cut-off operation until a predetermined period elapses after the end of the startup.

According to the invention, the cut-off circuit is prohibited from performing a cut-off operation until a predetermined period elapses after the end of the startup. In this manner, the regulated power supply circuit is adapted so that the cut-off circuit can perform a cut-off operation only after the regulated power supply circuit has completely started up.

The regulated power supply circuit in accordance with the present invention is preferably such that:

it includes a cut-off signal output circuit for supplying a signal indicative that the output of the output control element has been cut off.

According to the invention, a signal is output of the cut-off signal output circuit, indicating that the output of the output control element is cut off. The signal can be used to provide a display or warning that the overcurrent protection has been triggered.

The regulated power supply device in accordance with the present invention is preferably such that:

it is fabricated by integrating any one of the regulated power supply circuits in accordance with the foregoing inventions and sealing it in a single package.

According to the invention, the regulated power supply circuits in accordance with the foregoing inventions are integrated and sealed in a single package and can be readily mounted on a printed board.

The invention being thus described, it will be obvious that the same may be varied in many ways. Such variations are not to be regarded as a departure from the spirit and scope of the invention, and all such modifications as would be obvious to one skilled in the art intended to be included within the scope of the following claims.

What is claimed is:

1. A regulated power supply circuit, comprising:

an output control element for producing an output voltage by dropping an input voltage;

an overcurrent detection circuit in series with the output control element for detecting an overcurrent flowing through the output control element;

a cut-off circuit for cutting off an output of the output control element when the overcurrent detection circuit detects the overcurrent; and a cut-off operation prohibition circuit for prohibiting the cut-off circuit from performing the cut-off operation from an outset to an end of a startup of the regulated power supply circuit.

2. The regulated power supply circuit as defined in claim 1, further comprising:

a cut-off signal output circuit for supplying a signal indicative of the output control element having been cut off.

3. The regulated power supply circuit as defined in claim 1, wherein:

the cut-off operation prohibition circuit prohibits the cut-off operation until a predetermined period elapses after the end of the startup.

4. The regulated power supply circuit as defined in claim 3, further comprising:

a cut-off signal output circuit for supplying a signal indicative of the output control element having been cut off.

5. The regulated power supply circuit as defined in claim 1, further comprising:

a capacitor starting charging at the outset of the startup, wherein:

the cut-off operation prohibition circuit prohibits the cut-off operation during the startup until a potential difference across the capacitor reaches a value that can be regarded as an end of the startup.

6. The regulated power supply circuit as defined in claim 5, further comprising:

a cut-off signal output circuit for supplying a signal indicative of the output control element having been cut off.

7. The regulated power supply circuit as defined in claim 5, wherein:

the cut-off operation prohibition circuit prohibits the cut-off operation until a predetermined period elapses after the end of the startup.

8. The regulated power supply circuit as defined in claim 7, wherein:

the cut-off operation prohibition circuit includes:

an initial reset circuit for (i) starting charging the capacitor at the outset of the startup of the regulated power supply circuit and (ii) supplying a reset signal until the capacitor is charged to a voltage value that can be regarded as an end of the startup;

an RS flip-flop circuit for, as a result of being reset by the reset signal, (i) rejecting a set signal supplied by the overcurrent detection circuit having detected the overcurrent and (ii) supplying a signal to prohibit the cut-off circuit from performing the cut-off operation; and a timing circuit for delaying time to stop the initial reset circuit from supplying the reset signal to the RS flip-flop circuit by a predetermined amount when the capacitor has been charged to such a voltage that the output control element turns on.

9. The regulated power supply circuit as defined in claim 7, further comprising:

a cut-off signal output circuit for supplying a signal indicative of the output control element having been cut off.

10. The regulated power supply circuit as defined in claim 1, further comprising:

an output voltage detection circuit for detecting the output voltage of the output control element and supplying a result of the detection to the cut-off operation prohibition circuit, wherein:

the cut-off operation prohibition circuit prohibits the cut-off operation during the startup until the output voltage reaches a value that can be regarded as an end of the startup.

11. The regulated power supply circuit as defined in claim 10, further comprising:

a cut-off signal output circuit for supplying a signal indicative of the output control element having been cut off.

12. The regulated power supply circuit as defined in claim 10, wherein:

the cut-off operation prohibition circuit prohibits the cut-off operation until a predetermined period elapses after the end of the startup.

13. The regulated power supply circuit as defined in claim 12, wherein:

the cut-off operation prohibition circuit includes:

an initial reset circuit for supplying a reset signal until the output voltage of the output control element as detected by the output voltage detection circuit reaches a predetermined value that can be regarded as an end of the startup;

an RS flip-flop circuit for, as a result of being reset by the reset signal, (i) rejecting a set signal supplied by the overcurrent detection circuit having detected the overcurrent and (ii) supplying a signal to prohibit the cut-off circuit from performing the cut-off operation; and a timing circuit for delaying time to stop the initial reset circuit from supplying the reset signal to the RS flip-flop circuit by a predetermined amount when the output voltage has reached the predetermined value.

14. The regulated power supply circuit as defined in claim 12, further comprising:

a cut-off signal output circuit for supplying a signal indicative of the output control element having been cut off.

15. The regulated power supply circuit as defined in claim 1, further comprising:

an input voltage detection circuit for detecting the input voltage of the output control element and supplying a result of the detection to the cut-off operation prohibition circuit, wherein:

the cut-off operation prohibition circuit prohibits the cut-off operation during the startup until the input voltage reaches a predetermined value that can be regarded as an end of the startup.

16. The regulated power supply circuit as defined in claim 15, further comprising:

a cut-off signal output circuit for supplying a signal indicative of the output control element having been cut off.

17. The regulated power supply circuit as defined in claim 15, wherein:

the cut-off operation prohibition circuit prohibits the cut-off operation until a predetermined period elapses after the end of the startup.

18. The regulated power supply circuit as defined in claim 17, wherein:

the cut-off operation prohibition circuit includes:

an initial reset circuit for supplying a reset signal until the input voltage of the output control element as detected by the input voltage detection circuit reaches the predetermined value;

an RS flip-flop circuit for, as a result of being reset by the reset signal, (i) rejecting a set signal supplied by the overcurrent detection circuit having detected the overcurrent and (ii) supplying a signal to prohibit the cut-off circuit from performing the cut-off operation; and a timing circuit for delaying time to stop the initial reset circuit from supplying the reset signal to the RS flip-flop circuit by a predetermined amount when the input voltage has reached the predetermined value.

19. The regulated power supply circuit as defined in claim 17, further comprising:

a cut-off signal output circuit for supplying a signal indicative of the output control element having been cut off.

20. The regulated power supply circuit as defined in claim 1, wherein the overcurrent detection circuit represents an output current detection circuit for detecting an output current of the output control element and supplying a result of the detection to the cut-off operation prohibition circuit, wherein, the cut-off operation prohibition circuit prohibits the cut-off operation during the startup until the output current reaches a predetermined value that can be regarded as an end of the startup.

21. The regulated power supply circuit as defined in claim 20, further comprising:

a cut-off signal output circuit for supplying a signal indicative of the output control element having been cut off.

22. The regulated power supply circuit as defined in claim 20, wherein:

the cut-off operation prohibition circuit prohibits the cut-off operation until a predetermined period elapses after the end of the startup.

23. The regulated power supply circuit as defined in claim 22, wherein:

the cut-off operation prohibition circuit includes:

an initial reset circuit for supplying a reset signal until the output current of the output control element as detected by the output current detection circuit reaches the predetermined value;

an RS flip-flop circuit for, as a result of being reset by the reset signal, (i) rejecting a set signal supplied by the overcurrent detection circuit having detected the overcurrent and (ii) supplying a signal to prohibit the cut-off circuit from performing the cut-off operation; and a timing circuit for delaying time to stop the initial reset circuit from supplying the reset signal to the RS flip-flop circuit by a predetermined amount when the output current has reached the predetermined value.

24. The regulated power supply circuit as defined in claim 22, further comprising:

a cut-off signal output circuit for supplying a signal indicative of the output control element having been cut off.

25. A regulated power supply device, fabricated by sealing an integrated regulated power supply circuit in a single package, the regulated power supply circuit comprising:

an output control element for producing an output voltage by dropping an input voltage;

an overcurrent detection circuit in series with the output control element for detecting an overcurrent flowing through the output control element;

a cut-off circuit for cutting off an output of the output control element when the overcurrent detection circuit detects the overcurrent; and a cut-off operation prohibition circuit for prohibiting the cut-off circuit from performing the cut-off operation from an outset to an end of a startup of the regulated power supply circuit.

26. The regulated power supply circuit as defined in claim 25, further comprising:

a cut-off signal output circuit for supplying a signal indicative of the output control element having been cut off.

27. The regulated power supply device as defined in claim 25, wherein:

the cut-off operation prohibition circuit prohibits the cut-off operation until a predetermined period elapses after the end of the startup.

28. The regulated power supply circuit as defined in claim 27, further comprising:

a cut-off signal output circuit for supplying a signal indicative of the output control element having been cut off.

29. The regulated power supply device as defined in claim 25, further comprising:

a capacitor starting charging at the outset of the startup, wherein:

the cut-off operation prohibition circuit prohibits the cut-off operation during the startup until a potential difference across the capacitor reaches a value that can be regarded as an end of the startup.

30. The regulated power supply circuit as defined in claim 29, further comprising:

a cut-off signal output circuit for supplying a signal indicative of the output control element having been cut off.

31. The regulated power supply device as defined in claim 29, wherein:

the cut-off operation prohibition circuit prohibits the cut-off operation until a predetermined period elapses after the end of the startup.

32. The regulated power supply device as defined in claim 31, wherein:

the cut-off operation prohibition circuit includes:

an initial reset circuit for (i) starting charging the capacitor at the outset of the startup of the regulated power supply circuit and (ii) supplying a reset signal until the capacitor is charged to a voltage value that can be regarded as an end of the startup;

an RS flip-flop circuit for, as a result of being reset by the reset signal, (i) rejecting a set signal supplied by the overcurrent detection circuit having detected the overcurrent and (ii) supplying a signal to prohibit the cut-off circuit from performing the cut-off operation; and a timing circuit for delaying time to stop the initial reset circuit from supplying the reset signal to the RS flip-flop circuit by a predetermined amount when the capacitor has been charged to such a voltage that the output control element turns on.

33. The regulated power supply circuit as defined in claim 31, further comprising:

a cut-off signal output circuit for supplying a signal indicative of the output control element having been cut off.

34. The regulated power supply device as defined in claim 25, further comprising:

an output voltage detection circuit for detecting the output voltage of the output control element and supplying a result of the detection to the cut-off operation prohibition circuit, wherein:

the cut-off operation prohibition circuit prohibits the cut-off operation during the startup until the output voltage reaches a value that can be regarded as an end of the startup.

35. The regulated power supply circuit as defined in claim 34, further comprising:

a cut-off signal output circuit for supplying a signal indicative of the output control element having been cut off.

36. The regulated power supply device as defined in claim 34, wherein:

the cut-off operation prohibition circuit prohibits the cut-off operation until a predetermined period elapses after the end of the startup.

37. The regulated power supply device as defined in claim 36, wherein:

the cut-off operation prohibition circuit includes:

an initial reset circuit for supplying a reset signal until the output voltage of the output control element as detected by the output voltage detection circuit reaches a predetermined value that can be regarded as an end of the startup;

an RS flip-flop circuit for, as a result of being reset by the reset signal, (i) rejecting a set signal supplied by the overcurrent detection circuit having detected the overcurrent and (ii) supplying a signal to prohibit the cut-off circuit from performing the cut-off operation; and a timing circuit for delaying time to stop the initial reset circuit from supplying the reset signal to the RS flip-flop circuit by a predetermined amount when the output voltage has reached the predetermined value.

38. The regulated power supply circuit as defined in claim 36, further comprising:

a cut-off signal output circuit for supplying a signal indicative of the output control element having been cut off.

39. The regulated power supply device as defined in claim 25, further comprising:

an input voltage detection circuit for detecting the input voltage of the output control element and supplying a result of the detection to the cut-off operation prohibition circuit, wherein:

the cut-off operation prohibition circuit prohibits the cut-off operation during the startup until the input voltage reaches a predetermined value that can be regarded as an end of the startup.

40. The regulated power supply circuit as defined in claim 33, further comprising:

a cut-off signal output circuit for supplying a signal indicative of the output control element having been cut off.

41. The regulated power supply power as defined in claim 39, wherein:

the cut-off operation prohibition circuit prohibits the cut-off operation until a predetermined period elapses after the end of the startup.

42. The regulated power supply device as defined in claim 41, wherein:

the cut-off operation prohibition circuit includes:

an initial reset circuit for supplying a reset signal until the input voltage of the output control element as detected by the input voltage detection circuit reaches the predetermined value;

an RS flip-flop circuit for, as a result of being reset by the reset signal, (i) rejecting a set signal supplied by the overcurrent detection circuit having detected the overcurrent and (ii) supplying a signal to prohibit the cut-off circuit from performing the cut-off operation; and a timing circuit for delaying time to stop the initial reset circuit from supplying the reset signal to the RS flip-flop circuit by a predetermined amount when the input voltage has reached the predetermined value.

43. The regulated power supply circuit as defined in claim 41, further comprising:

a cut-off signal output circuit for supplying a signal indicative of the output control element having been cut off.

44. The regulated power supply device as defined in claim 33, wherein the overcurrent detection circuit represents a cut-off signal output circuit for supplying a signal indicative of the output of the output control element having been cut off.

45. The regulated power supply circuit as defined in claim 44, further comprising:

a cut-off signal output circuit for supplying a signal indicative of the output control element having been cut off.

46. The regulated power supply device as defined in claim 44, wherein:

the cut-off operation prohibition circuit prohibits the cut-off operation until a predetermined period elapses after the end of the startup.

47. The regulated power supply device as defined in claim 46, wherein:

the cut-off operation prohibition circuit includes:

an initial reset circuit for supplying a reset signal until the output current of the output control element as detected by the output current detection circuit reaches the predetermined value;

an RS flip-flop circuit for, as a result of being reset by the reset signal, (i) rejecting a set signal supplied by the overcurrent detection circuit having detected the overcurrent and (ii) supplying a signal to prohibit the cut-off circuit from performing the cut-off operation; and a timing circuit for delaying time to stop the initial reset circuit from supplying the reset signal to the RS flip-flop circuit by a predetermined amount when the output current has reached the predetermined value.

48. The regulated power supply circuit as defined in claim 46, further comprising:

a cut-off signal output circuit for supplying a signal indicative of the output control element having been cut off.

* * * * *